United States Patent [19]

Silver et al.

[11] 4,015,714

[45] Apr. 5, 1977

[54] MATERIAL HANDLING BOX HAVING A SIDE HOPPER AND DOOR

[75] Inventors: Robert L. Silver; Bert R. Eisenhut, both of Racine, Wis.

[73] Assignee: Triple E Corporation, Racine, Wis.

[22] Filed: Mar. 10, 1976

[21] Appl. No.: 665,509

[52] U.S. Cl. ..... 206/511; 220/345

[51] Int. Cl.[2] ..... B65D 21/02; B65D 43/12

[58] Field of Search ..... 206/511, 512; 211/126; 220/345, 346, 347

[56] References Cited

UNITED STATES PATENTS

| | | | |
|---|---|---|---|
| 173,360 | 2/1876 | Snider | 217/63 |
| 1,290,401 | 1/1919 | Stewart | 220/345 |
| 2,582,207 | 1/1952 | Shaw | 206/511 |
| 2,652,174 | 9/1953 | Shea | 206/386 |
| 3,083,057 | 3/1963 | Kiser | 220/345 |

*Primary Examiner*—George E. Lowrance
*Attorney, Agent, or Firm*—James E. Nilles

[57] ABSTRACT

A material handling box fabricated from sheet steel and having four generally vertical sides and a bottom wall, one of the sides being substantially open and having a hopper extending outwardly therefrom. The top of the hopper is open whereby access may be had through the open hopper top and into the interior of the box. A vertically slideable door is positioned over the opening in the side and which can be moved from a box closing position to any one of a number of vertically positioned locations to thereby expose the interior of the box to the hopper in the desired degree.

10 Claims, 11 Drawing Figures

MATERIAL HANDLING BOX HAVING A SIDE HOPPER AND DOOR

BACKGROUND OF THE INVENTION

Material handling boxes of the type to which the invention pertains find particular utility in storing various parts, for example in a manufacturing plant and transporting these boxes to various locations in the plant. Boxes of this type are commonly referred to as tote boxes and are used, for example, in production lines where the parts may be quickly and easily removed from the box by production workers. In conventional boxes, as the level of the parts therein decreases, it becomes increasingly difficult for the worker to reach the parts in the box. It has been proposed in storage or display boxes of this type to provide them with a hopper at one side for easy accessibility of the parts within the box. However, with such a hopper, the capacity of the box is generally reduced due to the open top required in the hopper.

An example of a conventional tote box of the type to which the invention pertains is shown in the U.S. Pat. No. 3,669,298, issued June 13, 1972, entitled "Material Handling Box" and which has been assigned to an assignee common to the present invention.

SUMMARY OF THE INVENTION

The present invention provides a metal material handling box fabricated from sheet steel and having four generally vertical sides and the bottom wall located between and within said sides and rigidly secured thereto; one of the sides is generally open and has an outwardly extending hopper therefrom, which hopper has an open top through which access may be gained into the interior of the box; the box also has a generally vertically shiftable door located between the box and the hopper, and located preferably in the wall of the box, which door can be vertically shifted from a box closed position and upwardly to any one of a number of selected positions in which the interior of the box is partially or fully exposed to the interior of the hopper. A more specific aspect of the invention relates to the hopper side walls being formed integrally with the one vertical side of said box which contributes to an economically formed structure, an especially rigid side wall structure and hopper construction, and a neat-appearing construction. The invention furthermore contemplates that the hopper has an upwardly and outwardly inclined bottom and has a downwardly and outwardly inclined, open top. Furthermore, the invention provides a vertically spaced guide means located at either side of the opening in the vertical side wall, which guide means slideably receives the vertically positionable door and contributes to a rigid side wall when in the closed position and which is capable of absorbing the thrust imposed upon it by the weight of the objects in the box when the latter is fully loaded.

The box provided by the present invention can be used to its full capacity because of the door, but on the other hand, when the door is raised to a partially open position, the worker can have easy access through the hopper and to the material in the box. As an alternative, the door can be completely removed and the box placed on a rack whereby the workers can easily select the material from the box.

Other objects and advantages of the invention will hereinafter appear as the invention progresses reference being had to the accompanying drawings.

DESCRIPTION OF THE PREFERRED EMBODIMENT

Figure 1:
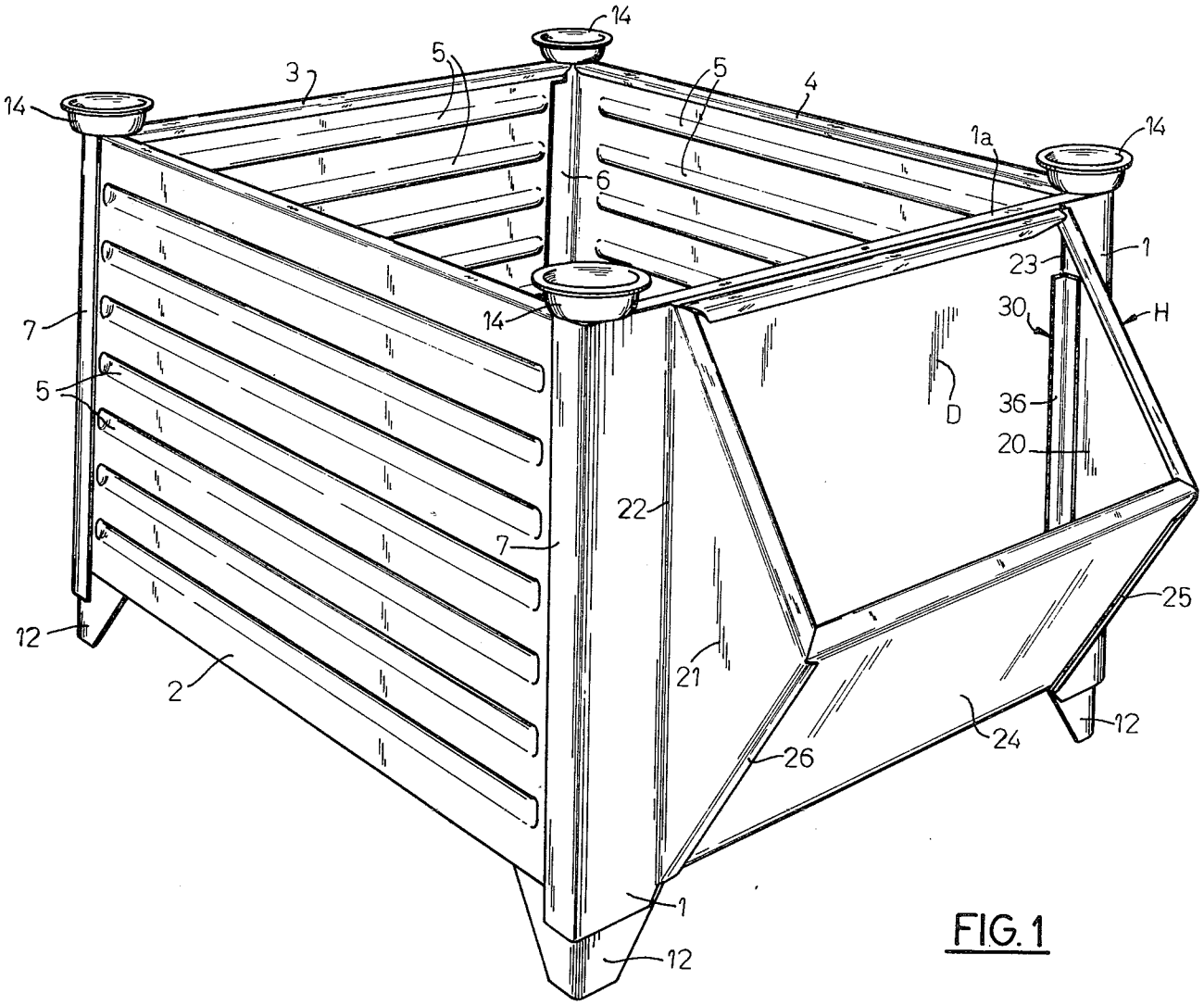
FIG. 1 is a perspective view of a box made in accordance with the present invention and taken generally from that side from which the hopper extends and showing the vertically slideable door in the closed position.

The metal material handling box is comprised of four sides 1, 2, 3, and 4, sides 2 and 4 of which may be identical. Sides 2, 3, and 4 are formed with horizontal corrugations 5 therein to increase the strength and rigidity thereof. Sides 3 and 4 have flanges 6 formed along either of their sides and which abut against sides 1 and 3. Sides 1 and 3 in turn have flanges 7 extending at right angles therefrom and formed integrally therewith and which can abut against sides 2 and 4. The sides can then be spot-welded together or otherwise rigidly secured together as by being bolted. A metal, rigid bottom wall 10 is located between and within the four sides and can be rigidly secured, as by welding, to the sides. Some of the sides may be formed with downwardly extending legs 12, and the upper side of the box has leg receptacles 14 secured thereto as by welding and at each corner thereof. In this manner, the boxes may be nested or stacked one on top of the other as is common practice.

In accordance with the present invention, a forwardly and outwardly extending hopper H extends from one of the sides 1. The hopper includes two generally vertical walls 20 and 21 which are formed integrally with the side 1 as by being bent at approximately 90° along the lines 22,23. Thus, the wall 1 of the box, a cross brace la and the side walls 20, 21, of the hopper form a rigid front and contribute to a particularly rigid and neat-appearing construction which is economically formed. The top edges of the walls 20, 21 are inclined downwardly and outwardly and define an open top for the hopper into which the worker can conveniently and easily reach. The bottom of the hopper is formed by an outwardly and upwardly extending sheet metal bottom 24 which rests on and can be welded to the inwardly turned flanges 25, 26, respectively, of hopper sides 20 and 21. In this manner, the hopper has an outwardly and downwardly inclined top and an outwardly and upwardly inclined bottom. Access to the interior of the box can be readily had through the open hopper top when a vertically slideable door, door D, to be presently described, is raised.

Figure 2:
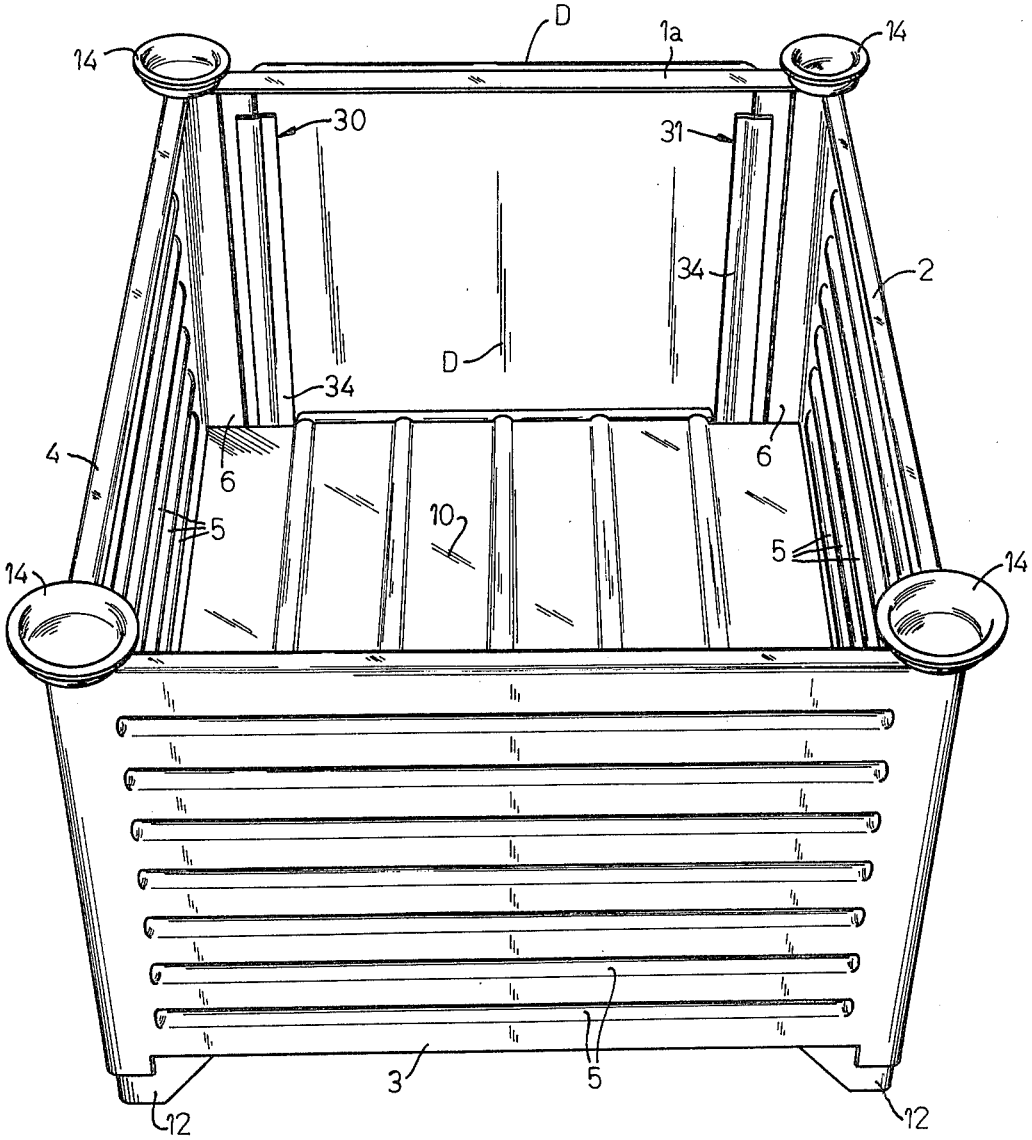
FIG. 2 is another perspective view of the box taken generally from the back side thereof and showing the door in the fully closed position.
Figure 3:
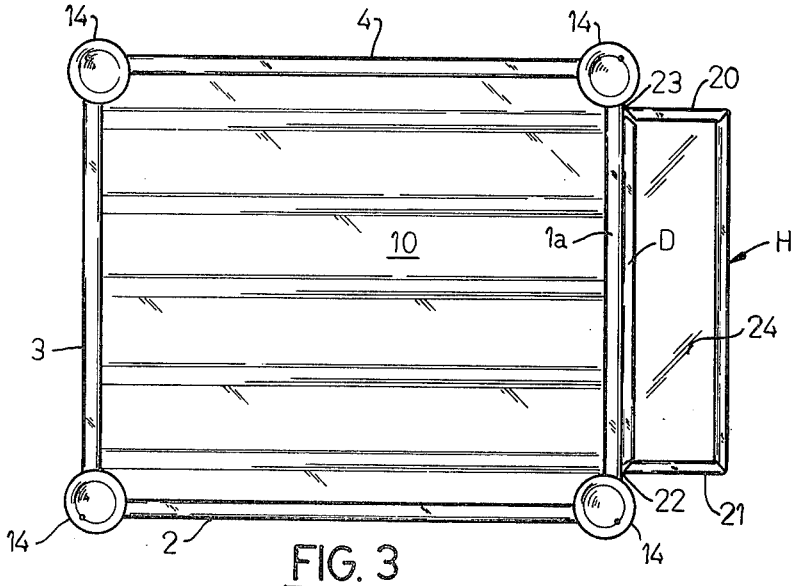
FIG. 3 is a top view of the box shown in FIGS. 1 and 2 but on a reduced scale.
Figure 4:
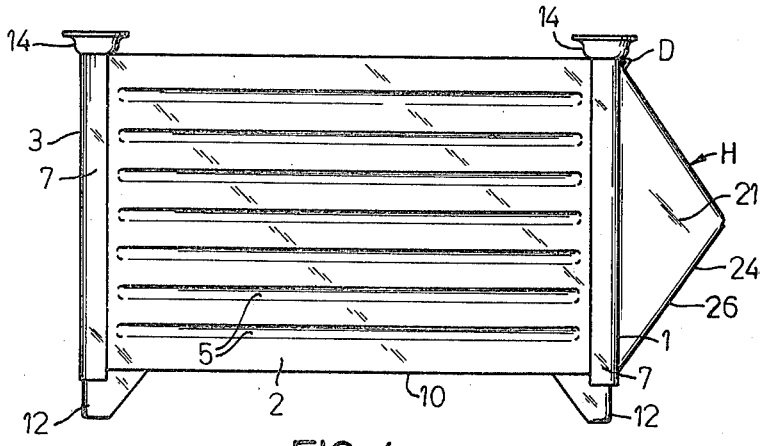
FIG. 4 is a side view of the box shown in FIG. 3.
Figure 5:
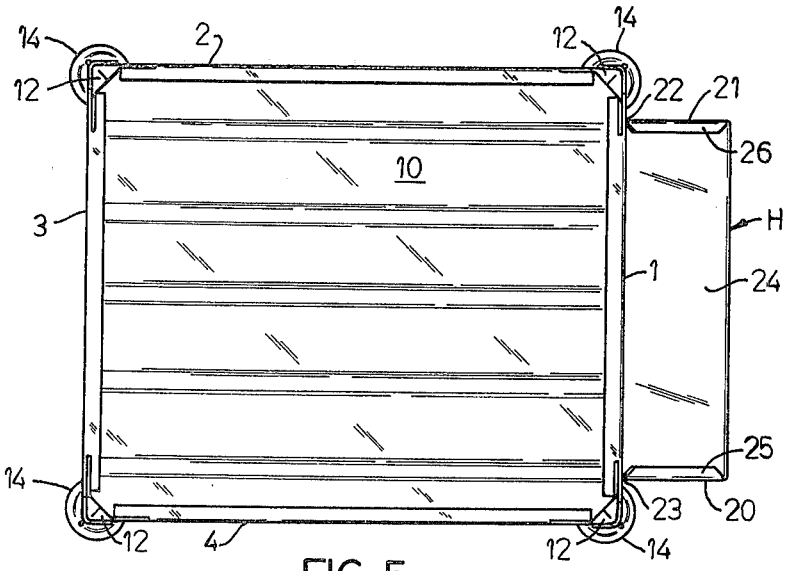
FIG. 5 is a bottom view of the box shown in FIGS. 3 and 4.
Figure 7:
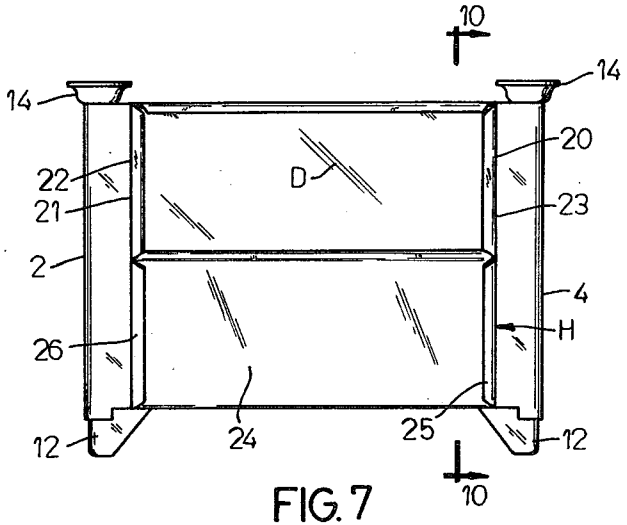
FIG. 7 is a front view of the box.
Figure 6:
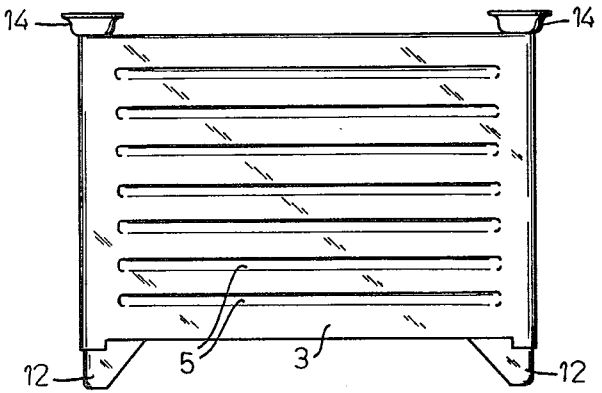
FIG. 6 is a rear view of the box shown in the other Figures.
Figure 8:
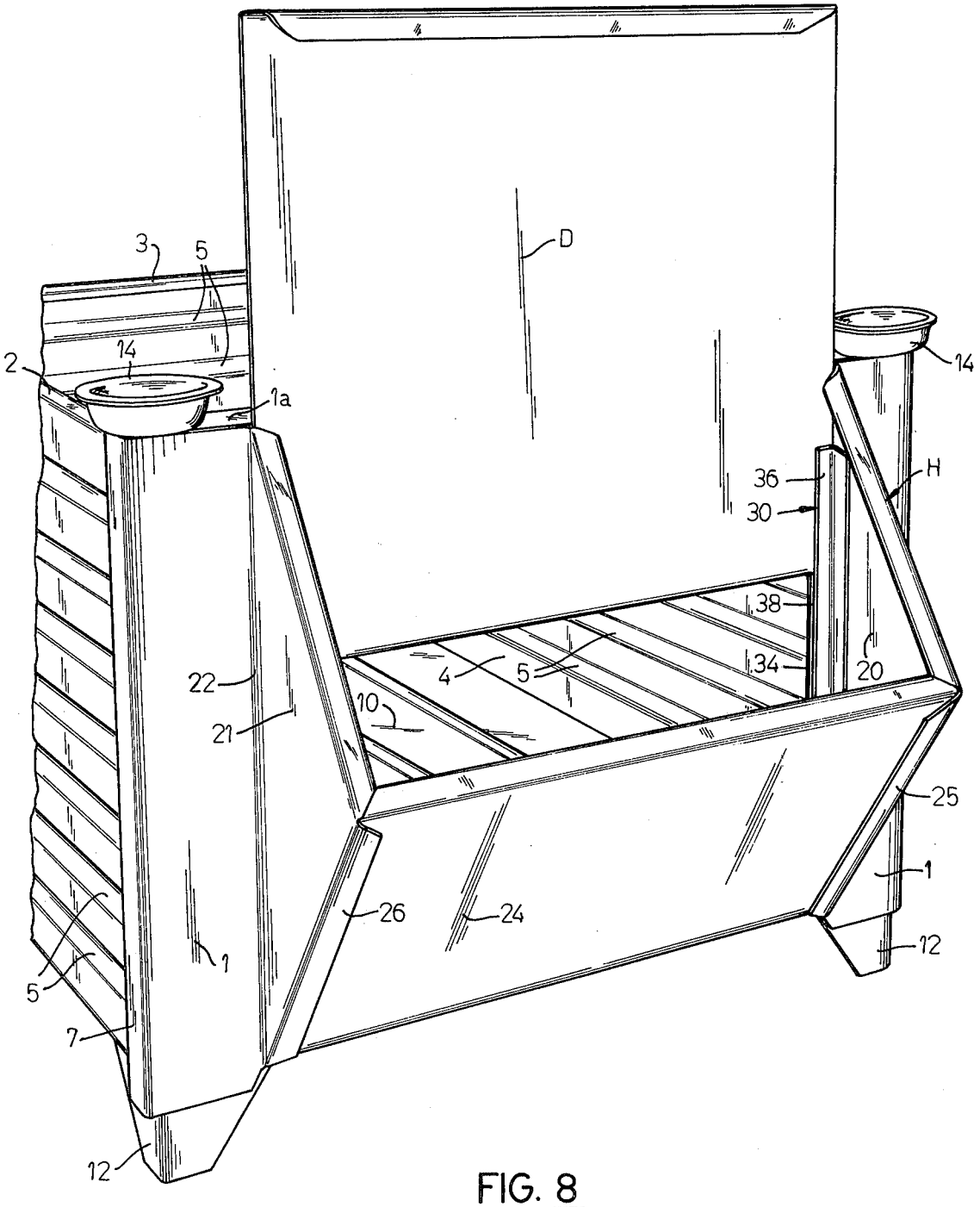
FIG. 8 is another perspective, fragmentary view of the box shown in FIG. 1 but on a further enlarged scale and furthermore showing the door in a partially raised position.
Figure 9:
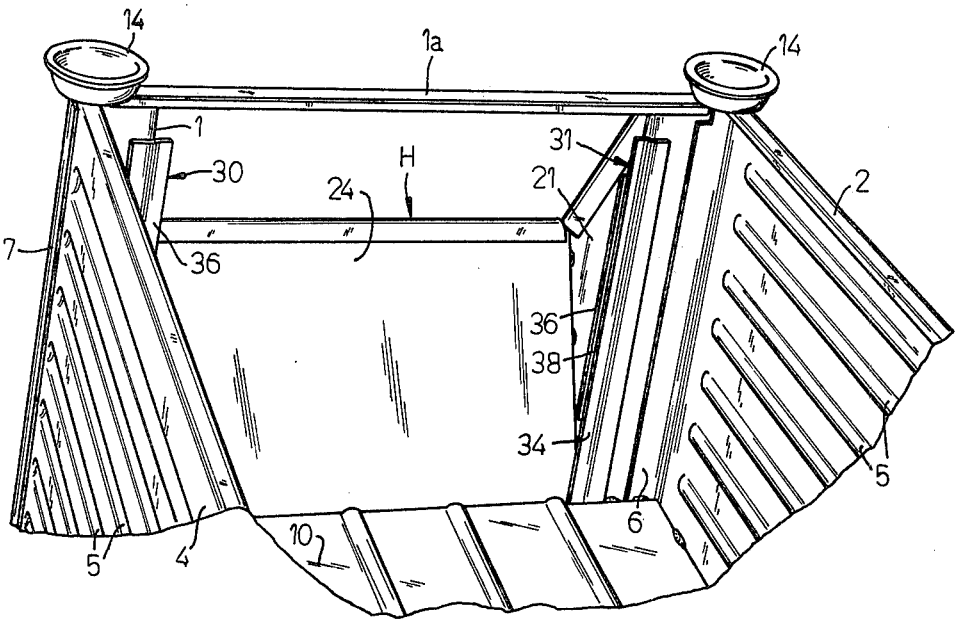
FIG. 9 is another perspective, fragmentary view of the box showing the door removed and looking outwardly through the opening in the side wall.
Figure 10:
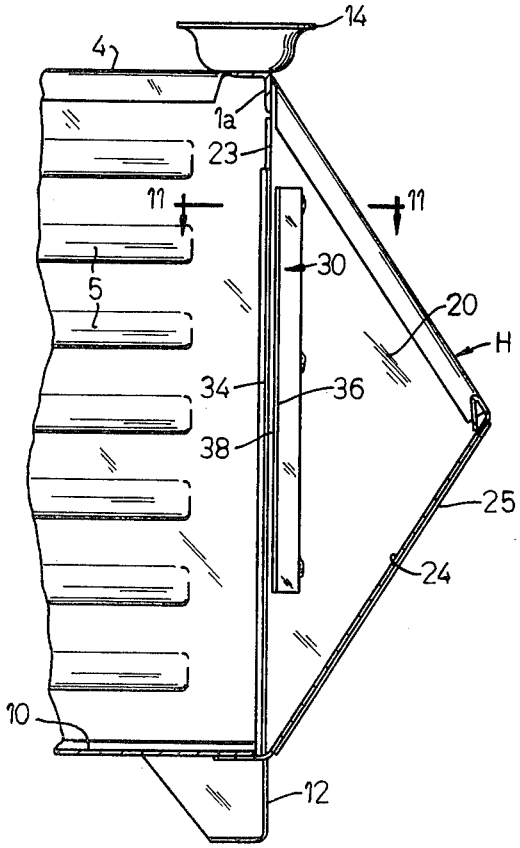
FIG. 10 is a vertical, fragmentary view, partially in section, the view being taken generally along the line 10—10 in FIG. 7 but on an enlarged scale.
Figure 11:
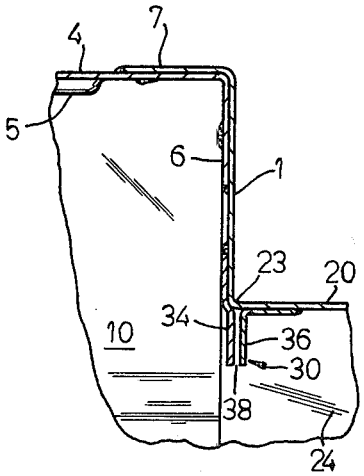
FIG. 11 is an enlarged, fragmentary sectional view taken generally along the line 11—11 in FIG. 10.

Along each vertical side of the opening defined in the vertical wall 1 is located a vertical guide means 30 and 31 for the vertically slideable door D. These guide means are formed by two spaced apart metal strips which are welded to the vertical side 1 adjacent each of the side edges thereof. More specifically, as shown in FIG. 2, for example, an interior vertical strip 34 is welded to the interior side of wall 1 and adjacent each side edge of the opening, and metal strips 36, formed as angle members (FIG. 11), are welded to the side walls of the hopper and are spaced from their adjacent strips 34 so as to define a vertical slot 38 (FIG. 11) which slideably receives the sheet metal door D. As shown in FIGS. 1 and 8, the door can be vertically shiftable in the vertical guide means from the closed position to a partially open position. The door can also be completely removed in an upward direction so that the opening in the one side wall is completely unobstructed, as shown in FIG. 9.

Recapitulation

The present invention provides a metal material handling box which is fabricated from four generally vertical side walls, one of the walls of which is formed with a substantial opening therein and which can be closed or partially open by means of a vertically slideable door therein. When the door is closed, the box is capable of containing its full capacity. The forwardly extending hopper has an open, inclined top that is readily accessible to the worker and to which access may be gained to the interior of the box in any desired degree depending on the vertical position of the door.

We claim:

1. A metal material handling box or the like formed from four vertical sides which are fabricated from sheet steel and welded together to form a one-piece unitary box, a bottom wall located between and within said sides and rigidly secured thereto, one of said sides having an outwardly extending hopper having a width extending partially across said one of said sides, said hopper having a downwardly and outwardly inclined open top, said one of said sides also having an opening coextensive with the width of said hopper whereby access to the interior of said box may be had through said inclined open top of said hopper, said hopper including two outwardly extending and generally vertically positioned sides which are formed integrally with said one of said sides of said box by being bent at approximate right angles to said one of said sides of said box, said hopper also including a bottom wall which is inclined upwardly and outwardly from said one of said sides of said box, generally vertical guide means in said one of said sides and along each edge of said opening, and a generally vertical shiftable door slideable in said vertical guide means whereby said opening in one of said sides can be completely closed or can be open to the extent to which the door is vertically raised.

2. The box set forth in claim 1 further characterized in that said hopper includes two outwardly extending and generally vertically positioned sides which are formed integrally with said one of said sides of said box by being bent at approximate right angles to said one of said sides of said box, said hopper also including a bottom wall which is inclined upwardly and outwardly from said one of said sides of said box.

3. The box set forth in claim 1 further characterized in that said vertical guide means includes spaced apart steel strips welded adjacent said one of said box sides to define a space between said strips and in which said door can be slid in a vertical direction.

4. The box set forth in claim 2 further characterized in that said vertical guide means includes spaced apart steel strips welded adjacent said one of said box sides to define a space between said strips and in which said door can be slid in a vertical direction.

5. The box as set forth in claim 1 including leg means extending downwardly from said box and also including receptacle means rigidly secured on the top of said box for the reception of leg means of an adjacent box to thereby permit stacking of said boxes.

6. The box as set forth in claim 2 including leg means extending downwardly from said box and also including receptacle means rigidly secured on the top of said box for the reception of leg means of an adjacent box to thereby permit stacking of said boxes.

7. A metal material handling box or the like formed from four vertical sides which are fabricated from sheet steel and welded together to form a one-piece unitary box, a bottom wall located between and within said sides and rigidly secured thereto, one of said sides having an outwardly extending hopper having a width extending partially across said one of said sides, said hopper having a downwardly and outwardly inclined open top, said one of said sides having an opening coextensive with the width of said hopper whereby access to the interior of said box may be had through said inclined open top of said hopper, generally vertical guide means along each edge of said opening, said vertical guide means including spaced apart steel strips welded adjacent said one of said box sides to define a space between said strips, a generally vertically shiftable door slideable in said space between said strips of said vertical guide means whereby said opening in one of said sides can be completely closed or can be open to the extent to which the door is vertically raised, said hopper icluding two outwardly extending and generally vertically positioned sides which are formed integrally with said one of said sides of said box by being bent at approximate right angles to said one of said sides of said box, said hopper also including a bottom wall which is inclined upwardly and outwardly from said one of said sides of said box, leg means extending downwardly from said box, and receptacle means rigidly secured to the top of said box for the reception of leg means of an adjacent box to thereby permit stacking of said boxes.

8. A metal material handling box or the like fabricated from sheet steel and having an outwardly extending hopper in communication with the interior of said box, said hopper having an open top whereby access to the interior of said box may be through said open top of said hopper, and a vertically shiftable door slideable generally between said box and said hopper.

9. The box set forth in claim 8 further characterized in that said hopper includes two outwardly extending and generally vertically positioned sides, said hopper also including a bottom wall which is inclined upwardly and outwardly from said box.

10. The box as described in claim 9 further characterized in that said hopper open top is inclined downwardly and outwardly from said box.

* * * * *